United States Patent [19]

Frank

[11] Patent Number: 4,679,518

[45] Date of Patent: Jul. 14, 1987

[54] FORKED THILL HEAD ATTACHMENT

[76] Inventor: Dieter Frank, Stangergasse 8, D-8242 Bischofswiesen, Fed. Rep. of Germany

[21] Appl. No.: 863,032

[22] Filed: May 14, 1986

[30] Foreign Application Priority Data

May 17, 1985 [DE] Fed. Rep. of Germany ..... 3517740

[51] Int. Cl.[4] ..... B63B 15/00

[52] U.S. Cl. ..... 114/98; 114/39

[58] Field of Search ..... 114/39, 39.2, 98, 99, 114/89, 97, 102, 103; 248/74.1, 74.3; 403/386, 389, 400; 24/329

[56] References Cited

U.S. PATENT DOCUMENTS

| | | | |
|---|---|---|---|
| 2,891,296 | 6/1959 | Darde | 248/74.1 |
| 4,448,142 | 5/1984 | Pollard | 114/39.2 |
| 4,516,873 | 5/1985 | Humble et al. | 114/39.2 |

FOREIGN PATENT DOCUMENTS

| | | | |
|---|---|---|---|
| 3046470 | 7/1982 | Fed. Rep. of Germany | 114/39.2 |

*Primary Examiner*—Joseph F. Peters, Jr.

*Assistant Examiner*—Jesûs D. Sotelo

*Attorney, Agent, or Firm*—Orrin M. Haugen; Thomas J. Nikolai; Frederick W. Niebuhr

[57] ABSTRACT

A forked thill head attachment for installing a forked thill to a sail mast of a rigging comprises a forked thill head (1) which, in a top view, is constructed essentially V-shaped, and opposed clamping jaws for gripping about the mast having a rearward vertical gap (17). In order to produce a firm connection between a forked thill and a mast for a rigging, that can be firmly locked and released with little expenditure of force, the clamping jaws (13) are constructed as a separate component from the forked thill head (1) and held by a longitudinal bolt (21) guided through the forked thill head (1) in the longitudinal direction in the plane of longitudinal symmetry. Locking rotation of the screw member provided at the forward outer side of the forked thill head (1) over the longitudinal bolt (21), moves clamping jaws (13) in the longitudinal direction while contacting, in the forward direction, contacting surfaces (11) likewise running, in a top view, V-shaped to one another. A still further simplified manipulation can be achieved (FIG. 5) by an additional quick-locking lever (51).

13 Claims, 8 Drawing Figures

FIG.7
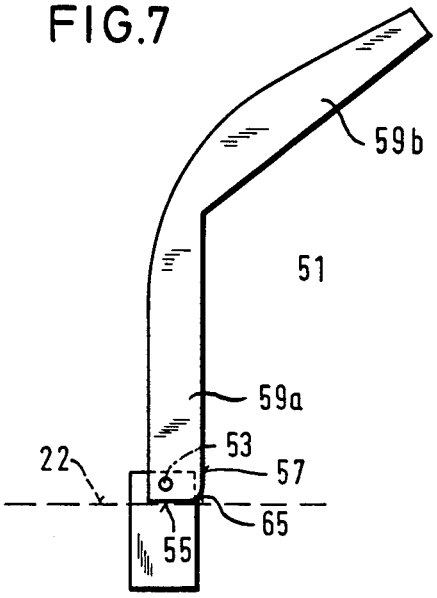
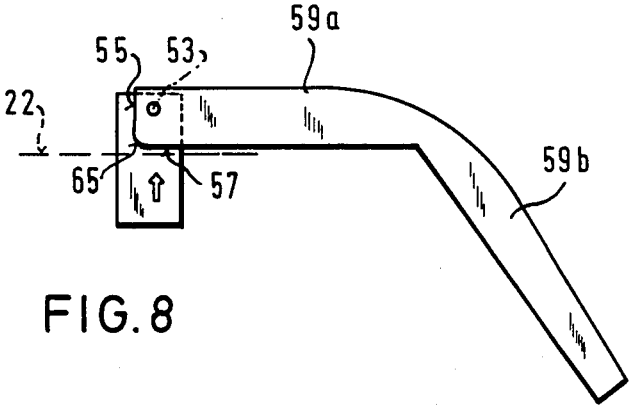
FIG.8

FORKED THILL HEAD ATTACHMENT

BACKGROUND OF THE INVENTION

The invention concerns a forked thill head attachment for adjustably mounting a forked thill to a mast of a rigging.

Known from DE-OS No. 33 15 987 is a mast/forked thill connection, for a rigging for a surfboard which, according to FIG. 14, comprises a guide disposed in a recess in the forked thill head. On the lagging end of the guide are installed two clamping jaws on appropriate add-on members. The add-on members are slightly conically tapered toward the front and are firmly pressed into a corresponding recess in the forked thill head by a screw element located at the front end in the forked thill head. The screw element acts upon the flexible suspension in the direction for shortening in order to achieve the clamping effect.

However, this arrangement has several disadvantages. For one thing, a firm attachment and gripping about a mast cannot be achieved through such a flexible suspension. Moreover, manufacturing difficulties arise from the relatively complicated recess into which the flexible suspension must be brought. Besides this, since the clamping jaws are supported only on the add-on members on the forked thill head, a firm gripping about a mast is not guaranteed. Above all, even if mast thicknesses vary only slightly, the clamping jaws may not grip the mast firmly enough, because they already lie against one another at their parting line. On the other hand, if the mast is thicker, the add-on members supporting the clamping jaws cannot be pressed completely into the corresponding recess on the forked thill head, so that there exists only point or line contact between the members and the rim of the recess on the inside part of the forked thill head. This results in only a relatively loose and unsteady connection.

Known also from U.S. Pat. No. 4,516,873 is a forked thill-mast connection comprising two clamping jaws encircled by the forked thill head. Here, by pivoting of the forked thill head, the clamping jaws gripping about the mast will be able to support themselves.

However, the disadvantage - if the mast is thinner - is that no firm encirclement is realized. If a somewhat thicker mast is used, this can lead to non-functionability of the arrangement since, the forked thill cannot be swung into its horizontal position of usage, because the two clamping jaws cannot be pressed together into the required compressed end-position.

Moreover, in the first reference treated, tilting of the forked thill and firm locking of the mast cannot be accomplished simultaneously. Actually, in the second reference treated this is possible, but with the disadvantage that a firm support of the clamping jaw, gripping about the mast on the inner side of the forked thill head, is no longer certain.

Forked thill head attachments are also known from DE-OS Nos. 28 46 017 and 28 21 263. In these arrangements, the forked thill head is bendable at least slightly at its forward end, or subsequently swingable or movable, whereby a fixing arrangement running transversely between both halves of the forked thill head is said to enable a firm attachment to the mast. However, a firm connection here is possible only with a tiresome rotation of the attaching mechanism, and, because of the small diameter of an associated knurled nut, the forces to be applied are so great that connection is not practical with the fingers.

Moreover, the threaded rod may turn in a direction to be loosened during surfing. In the case of this last mentioned reference, there is shown no appropriate adjustment.

SUMMARY OF THE INVENTION

The task for the present invention is to obtain a forked thill head attachment which, even for different mask thicknesses, enables an optimal and firm connection between the forked thill and a mast for a rigging. Using the thill head attachment requires a low expenditure of force even when the forked thill, due to different sail sizes, is set up in different vertical angular positions relative to the mast. The task is resolved in accordance with the invention in correspondence to the features given in the characterizing portion of claim 1. Advantageous embodiments of the invention are recited in the dependent claims.

Also obtained by the present invention is an easily manipulable forked thill head attachment that can be installed securely to a mast without great expenditure of force while adapting to different mast thicknesses. The secure and firm attachment is assured, among other things, in that the clamping jaws support themselves directly on the inner support surfaces of the forwardly tapering accommodating space of the forked thill head. Additionally, since the clamping jaws can be swung over a tilting axis lying perpendicularly to the vertical longitudinal plane of symmetry of the forked thill, it is possible to select different angular positions of the forked thill relative to the mast without impairing a firm connection between forked thill and mast. This remains true in the case of different mast thicknesses.

In one preferred embodiment according to claim 3, a tilting movement is obtained by using a vertical oblong hole, and in a preferred form of embodiment according to claim 4, by using a ball and/or a horizontal-semi-cylindrical recess in the clamping jaws and pointing toward the front, over which a correspondingly convex bolt head supports itself.

In order to enable a clamping movement of the two clamping jaws toward one another, in accordance with claim 5, the clamping jaws can be constructed in two separate parts, preferentially joined with one another by elastic connecting straps. However, according to claim 6, the two clamping jaws can be part of an at least partially elastic clamping cylinder slotted vertically at the rear.

According to a preferred embodiment of claims 8 to 12, installation of the forked thill head to the mast is simplified further by providing a quick locking lever at the forward adjustment section of the screwed connection. This quick-locking lever can be pivoted over a dead point between a locked and an open position. By appropriate rotation of the screw member, it is possible to adapt the thill head attachment to a particular mast thickness. With an open quick-locking lever, the forked thill head can be moved vertically along the mast. Then, by pivoting the quick-locking lever into its locked position, the longitudinal bolt can be pulled further forward so that the clamping jaws grip firmly about the mast. Hence, a faster opening and closing results through means of this lever.

IN THE DRAWINGS

Further advantages, particulars and features of the invention are obtained from the following detailed description, with the aid of the drawings, in which:

FIG. 7 shows an open position of the quick-locking lever; and

FIG. 8 shows a locking position of the quick-locking lever.

DESCRIPTION OF THE PREFERRED EMBODIMENT

Figure 1:
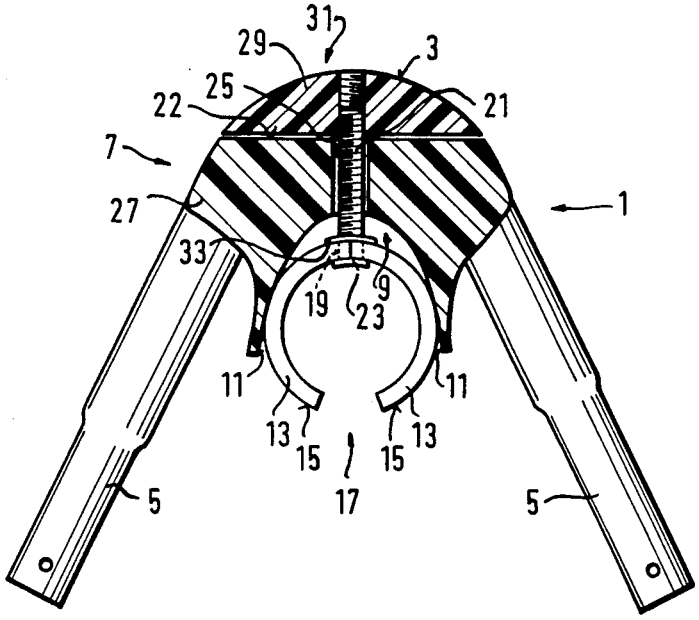
FIG. 1 is a top view of a forked thill head, in a horizontal sectional illustration.

Shown in FIG. 1 is a forked thill head that includes two essentially V-shaped struts 5 extending out from its forward forked thill head end 3, via which, by attaching the other parts, it is possible to produce a completely spread-out forked thill.

The forked thill head includes on its forward end a covering 7, advantageously a plastic covering with an internally lying accommodating space 9 which, in the top view, is also provided with V-shape embodied contact surfaces 11.

Provided for firm anchoring of the forked thill to a mast, not shown in any more detail, are clamping jaws 13 which, in the example of embodiment shown, form a clamping cylinder 15 lying approximately vertically, and having a rearward vertical gap 17. In the installed condition, the clamping cylinder 15 grips about the mast, not shown in any more detail, with the unfolded sail running through the gap 17 to the back end of the forked thill and being trimmed there.

The clamping jaws 13 embodied in the form of the clamping cylinder 15 are provided, at their forwardly pointing jacket area, with a boring 19 at the center, through which projects a longitudinal bolt 21 having a large bolt head 23. Additionally located in the forked thill head is another appropriate longitudinal boring 25 aligning with the boring 19, through which the shaft of the longitudinal bolt 21 projects.

As can be seen from the drawing represented, the covering 7 of the forked thill head 1 is split in two transversely to the longitudinal bolt 21 along a forked thill head limiting plane 22, whereby is formed a carrying section 27 and an adjusting section 29. The adjusting section 29 serves as a screw member 31 that is provided with an internal thread corresponding to the external thread of the longitudinal bolt 21.

Attachment of the forked thill to a mast is now described.

With a loose configuration of the clamping cylinder 15, with a larger internal diameter than the external diameter of the mast, and with a sail pulled over the mast, the forked thill is placed over the mast from above or from below, so that the sail runs through the rear gap 17. Next, by rotating the adjustment section 29 of covering 7 (serving as a screw member 31) the longitudinal bolt 21 is increasingly screwed further into the forward forked thill head end 3, whereby the clamping cylinder 15 is pulled further into the V-shaped, tapering accommodating space 9. Since the inner contacting surfaces 11 also taper forwardly in V-shape fashion, the two clamping jaws 13 of the clamping cylinder 15 are urged toward one another until they firmly encircle the mast, which is not shown in any more detail in the figure. The loosening procedure is done in the opposite direction.

The screw member 31 displays relatively large lever arms so that firm mounting of the forked thill is accomplished relatively easily in spite of the large forces involved. By appropriately embodied contacting surfaces 11, friction can be reduced to facilitate locking. On the other hand, for more positive seating, the contacting surfaces 11 and the outer jacket at the clamping cylinder 15 can be constructed to increase friction. Because of the large lever arms of the screw member 31, locking remains relatively easy.

In the example of embodiment shown, the clamping cylinder 15 can, for example, consist of a one-piece plastic member that is at least partially elastic. However, as is represented in the drawing, the clamping cylinder 15 can consist of two halves separated at the parting gap 17 and joined with one another at the forward end by two or more connecting straps 33. In this case, the two halves of the clamping cylinder 15 can also be produced of one metal part, with the connecting straps 33 being installed under tension on both halves of the clamping cylinder 15 such that in the loosened condition, the two halves of the clamping cylinder 15 continually tend to spread apart from one another.

Figure 2:
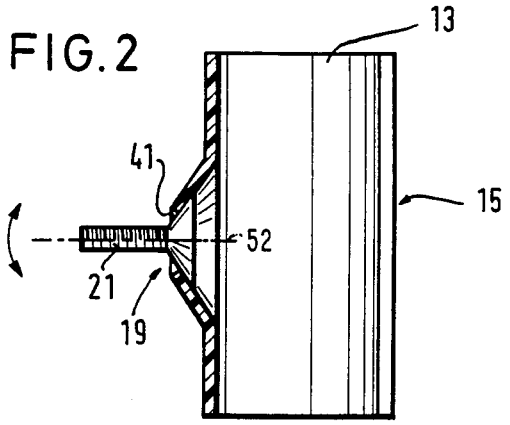
FIG. 2 is a vertical sectional representation through a longitudinal bolt head on the clamping jaws.
Figure 3:
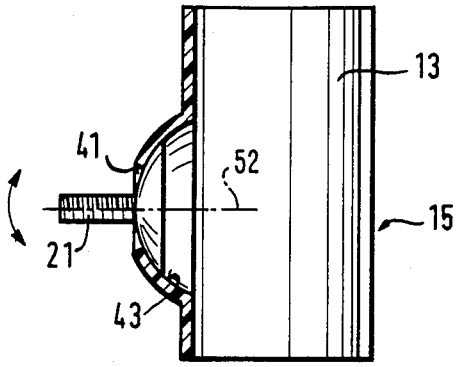
FIG. 3 illustrates an alternative embodiment to FIG. 2.

In many cases, the sails have shapes, whereby the forked thill is positioned higher or lower at a back end. Thus the forked thill head 1 must tilt relative to the mast and relative to the clamping cylinder 15. According to FIG. 2, this can be done by structuring the mentioned boring 19 as a vertical oblong hole 41 so that, in a side view, the clamping cylinder 15 can be pivoted, relative to the longitudinal bolt 21, within the vertical plane of longitudinal symmetry of the forked thill. Alternatively, in place of the bolt head 23, a modified bolt head can be used, with at least semi-spherical or semi-cylindrical forwardly pointing contacting surfaces 43 in accordance with FIG. 3. Surfaces 43 are seated in a corresponding semi-spherical and/or semi-cylindrical recess formed in the clamping cylinder 15, or in an add-on piece fastened or provided thereupon and located forwardly.

Figure 4:
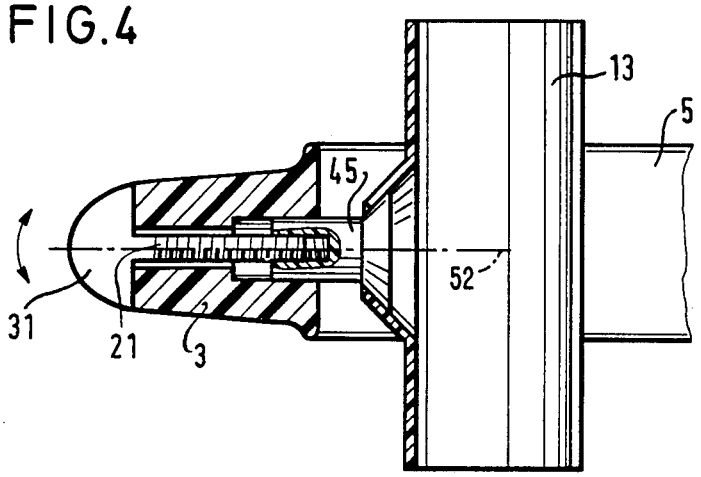
FIG. 4 is an embodiment related to FIG. 1, in a vertical sectional representation through a forked thill head.

Pivoting in the desired fashion can likewise be undertaken by means of this embodiment. The axis of pivoting appears as a point in FIGS. 2–4, and is identified by the reference numeral 52. It is noted that the longitudinal bolt 21 can be firmly cast in the forward adjustment section 29 forming the screw member 31 for rotation with the screw member 31. In this case, in accordance with FIG. 4, it is recommended that an anchoring section 45 be provided at the clamping cylinder 15, pointing forwardly and having appropriate internal threads in which the longitudinal bolt 21 engages. By rotating the screw member 31, the longitudinal bolt 21 will not actually be pushed in the longitudinal direction; rather, the clamping jaws 13, formed in the same manner like the clamping cylinder 15, will, when drawing up, be guided forwardly into the V-shaped accommodating space 9 over the anchoring section.

Reference is made to FIGS. 5 to 8, in which are shown a quicklocking lever 51.

The forward adjustment section 29 of the forked thill attachment is here structured in cap-fashion and, similarly as in FIG. 1, is screwed onto the longitudinal bolt 21 provided with external threads. Naturally, the adjustment section can also be constructed in a singlepiece with the longitudinal bolt if a corresponding anchoring section 45 is used. At the forward region of the adjustment section 29 extending above the forked thill head limiting surface 22, the quick-locking lever 51 pivots about a pivoting axis 53 between the locked position shown in FIG. 5 and 8 and the open position shown in FIG. 7.

As is obtained in particular from FIG. 7 and 8, the distance between the axis of pivoting 53 and the contacting surface 55 shown in FIG. 7 is less than the distance between the axis of pivoting 53 and the contacting surface 57 perpendicular to the first contacting surface 55. Contacting surface 57 adjoins, in accordance with FIG. 8, the forked thill head limiting plane 22 in the locked position. By pivoting from the open position of FIG. 7 into the locked position of FIG. 8, the screwed attachment is further adjusted in the forward direction so that the clamping jaws 13 are drawn further into the V-shaped recess. In application, in the open position of the locking lever in accordance with FIG. 7, the screwed connection is first set by rotating the lever, in particular shortened, such that the clamping jaws 13 grip about the mast, but can be displaced in the longitudinal direction of the mast. Afterwards, the quick-locking lever is pivoted to the locked position, with the adjustment section 29 being further lifted outwardly in accordance with the arrow shown in FIG. 8. In the final locked position, the clamping jaws 13 now grip firmly about the mast, now shown in any further detail in the drawings.

During opening and closing of the fast-locking lever 51, it must be pivoted over a dead point position, which securely holds the lever in the desired position. The dead point position is established by the distance between the axis of pivoting 53 and the transition edge 65 between the two contacting surfaces 55 and 57. The transition edge 65 is slightly rounded for easier actuation.

When the forked thill head attachment is preset by appropriate rotation, a simple and rapid adjustment of the height of attachment of a thill to the mast is possible during surfing on the water, by actuating the fast-locking tilt lever 51.

In order that the quick-locking lever 51 not project in its locked position, it includes two lever sections **59*a* and 59*b*. The first lever section 59*a* in its locked position runs parallel to the forked thill head limiting plane 22, and the second angular lever section 59*b* adjoining thereto runs parallel to the corresponding forked thill strut 5. Also capable of being provided at the end of this second lever section 59b is yet another clamping section 61 gripping partially over the outer jacket surface of the forked thill strut 5**, so that the lever is also secured against a self-actuated pivoting during use.

Figure 5:
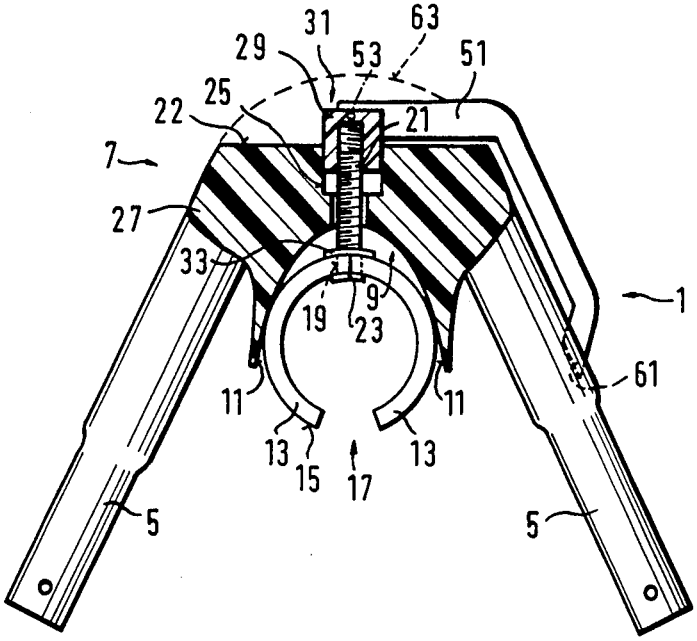
FIG. 5 is a horizontal top view of another embodiment of a forked thill head, in horizontal section.
Figure 6:
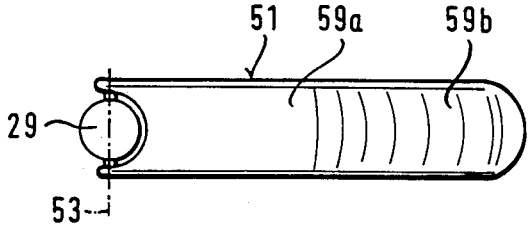
FIG. 6 is a front view of the quick-locking lever shown in FIG. 5.

Finally, as is indicated with a broken line in FIG. 5, it is possible to place a cap 63, made of rubber or some other elastomer material, on the forward end of the forked thill head.

Further, the clamping jaws 13 formed in the shape of a clamping cylinder 15 can have a layer of rubber on the inside surface that lies against the mast. This layer can be glued on or vulcanized. Alternate materials are also possible, so that friction-locking between the clamping jaws and the mast can be further increased. As a result, the adjustment screw need not be drawn up so tightly.

The length of the longitudinal bolt 21 can be dimensioned such that when rotating the adjustment section 29, the clamping cylinder and the two clamping jaws 13 can be guided out rearwardly from the V-shaped accommodation space 9, far enough so that the rear vertical gap 17 opens by an amount greater than the diameter of the mast. Consequently, the forked thill head, with an open clamping cylinder 15, can be placed directly from the front onto a mast, and then by rotating the adjustment section be securely attached.

I claim:

1. A forked thill head attachment for installing a forked thill to a mast of a rigging, with a V-shaped forked thill head, clamping jaws for gripping about the mast and forming a rearward vertical gap, said clamping jaws being constructed as a separate component from the forked thill head for detachable mounting to the mast together with a forward lying adjustment section of the forked thill head by a longitudinally alterable screw contrivance provided in the forked thill head in the region of the vertical longitudinal plane of symmetry of the clamping jaws, rotation of the adjustment section displacing the clamping jaws in the forward direction and pressing them toward one another, characterized in that said screw contrivance includes a longitudinal bolt running through the forked thill head in the longitudinal direction and joining the clamping jaws with respect to said adjustment section, said bolt being threaded such that rotating said screw contrivance presses said adjustment section and the clamping jaws toward one another, with said jaws contacting forwardly tapered inner contacting surfaces of an accommodating space of the forked thill head, said clamping jaws pivoted over a tilting axis lying perpendicularly to the vertical longitudinal plane of symmetry of the forked thill, wherein said clamping jaws are provided, substantially in the vertical plane of longitudinal symmetry, with a boring that is penetrated by the longitudinal bolt, with the clamping jaws being held by a bolt head integral with said bolt and having a larger diameter as compared to the inner diameter of the boring in the clamping jaws.

2. The forked thill head attachment according to claim 1, further characterized in that said boring penetrated by the longitudinal bolt is formed in a clamping cylinder including said jaws and is embodied as a vertical oblong hole.

3. The forked thill head attachment according to claim 1, further characterized in that said bolt head holds a clamping cylinder including said jaws and is shaped semi-spherically in the direction toward the forward end of the forked thill head and lies in a correspondingly contoured recess integral with said clamping cylinder.

4. The forked thill head attachment according to claim 1, further characterized in that said bolt head holds a clamping cylinder including said jaws and is shaped horizontally semi-cylindrically in the direction toward the forward end of the forked thill head and lies in a correspondingly contoured recess integral with said clamping member.

5. The forked thill head attachment according to claim 1, further characterized in that the clamping jaws comprise two pieces that form a forward, vertically running parting gap, and are joined with one another under tension by connecting straps.

6. The forked thill head attachment according to claim 1, further characterized in that a clamping cylinder including said jaws is at least partially elastically bendable, and, in the unloaded condition, has a larger internal diameter than the external diameter of the mast.

7. The forked thill head attachment according to claim 1, further characterized in that the longitudinal bolt has a length such that in the open condition the clamping jaws can be pushed out far enough from the forwardly tapering accommodating space that the rear vertical gap is larger than the diameter of the mast.

8. A forked thill head attachment for installing a forked thill to a mast of a rigging, with a V-shaped forked thill head, clamping jaws for gripping about the mast and forming a rearward vertical gap, said clamping jaws being constructed as a separate component from the forked thill head for detachment mounting to the mast together with a forward lying adjustment section of the forked thill head by a longitudinally alterable screw contrivance provided in the forked thill head in the region of the vertical longitudinal plane of symmetry of the clamping jaws, rotation of the adjustment section displacing the clamping jaws in the forward direction and pressing them toward one another, characterized in that said screw contrivance includes a longitudinal bolt running through the forked thill head in the longitudinal direction and joining the clamping jaws with respect to said adjustment section, said bolt being threaded such that rotating said screw contrivance presses said adjustment section and the clamping jaws toward one another, with said jaws contacting forwardly tapered inner contacting surfaces of an accommodating space of the forked thill head, said clamping jaws pivoted over a tilting axis lying perpendicularly to the vertical longitudinal plane of symmetry of the forked thill, wherein said forked thill head attachment further includes a covering at a forked thill head end, wherein said covering is split at the forward forked thill head end in a plane that is transverse to the longitudinal bolt, with said adjustment section comprising a part of the covering and being embodied as a screw member.

9. A forked thill head attachment for installing a forked thill to a mast of a rigging, with a V-shaped forked thill head, clamping jaws for gripping about the mast and forming a rearward vertical gap, said clamping jaws being constructed as a separate component from the forked thill head for detachment mounting to the mast together with a forward lying adjustment section of the forked thill head by a longitudinally alterable screw contrivance provided in the forked thill head in the region of the vertical longitudinal plane of symmetry of the clamping jaws, rotation of the adjustment section displacing the clamping jaws in the forward direction and pressing them toward one another, characterized in that said screw contrivance includes a longitudinal bolt running through the forked thill head in the longitudinal direction and joining the clamping jaws with respect to said adjustment section, said bolt being threaded such that rotating said screw contrivance presses said adjustment section and the clamping jaws toward one another, with said jaws contacting forwardly tapered inner contacting surfaces of an accommodating space of the forked thill head, said clamping jaws pivoted over a tilting axis lying perpendicularly to the vertical longitudinal plane of symmetry of the forked thill, wherein a tiltable quick-locking lever is linked to a pivoting axis directed transversely to the longitudinal axis of the longitudinal bolt for moving the longitudinal bolt and the clamping jaws further in a forward locking direction.

10. The forked thill head attachment according to claim 9, further characterized in that the distance between the pivoting axis and a first contacting surface of the quick-locking lever which, in the open position, lies against a forward forked thill head limiting plane running perpendicularly to the longitudinal bolt, is less than the distance between the pivoting axis and a second contacting surface of the quick-locking lever which, in its locked position, is in immediate contact with the forward forked thill head limiting plane.

11. The forked thill head attachment according to claim 9, further characterized in that the quick-locking lever is provided with a dead point position between its open position and its locked position.

12. The forked thill head attachment according to claim 9 further characterized in that the quick-locking lever includes two lever sections that are at an angle to one another, whereby, in the locked position, the first lever section runs parallel to the forward forked thill head limiting plane and the adjacent second lever section runs parallel to an adjacent forked thill strut.

13. The forked thill head attachment according to claim 12, further characterized in that there is provided at the second lever section a clamping section gripping about the outer jacket section of the forked thill strut, at least in one partial region.

* * * * *